US007666565B2

(12) United States Patent
Liu et al.

(10) Patent No.: US 7,666,565 B2
(45) Date of Patent: Feb. 23, 2010

(54) METHOD OF FORMING ELECTROPHOTOGRAPHIC TONER

(75) Inventors: Ming-Huei Liu, Hsinchu County (TW); Chih-Chia Hung, Taipei County (TW); Fang-Yi Hsu, Hsinchu City (TW)

(73) Assignee: Sinonar Corp., Hsinchu (TW)

( * ) Notice: Subject to any disclaimer, the term of this patent is extended or adjusted under 35 U.S.C. 154(b) by 505 days.

(21) Appl. No.: 11/211,719

(22) Filed: Aug. 26, 2005

(65) Prior Publication Data

US 2007/0048654 A1 Mar. 1, 2007

(51) Int. Cl.
*G03G 9/08* (2006.01)

(52) U.S. Cl. ..... 430/137.14; 430/110.4

(58) Field of Classification Search ..... 430/108.1, 430/137.14; 523/333, 335
See application file for complete search history.

(56) References Cited

U.S. PATENT DOCUMENTS

| | | | | |
|---|---|---|---|---|
| 3,959,153 | A | 5/1976 | Sadamatsu et al. | |
| 4,816,366 | A | 3/1989 | Hyosu et al. | |
| 4,833,060 | A | 5/1989 | Nair et al. | |
| 4,835,084 | A | 5/1989 | Nair et al. | |
| 5,049,469 | A | 9/1991 | Pierce et al. | |
| 5,283,149 | A | 2/1994 | Tyagi et al. | |
| 5,290,654 | A * | 3/1994 | Sacripante et al. | 430/137.14 |
| 5,298,355 | A | 3/1994 | Tyagi et al. | |
| 5,418,108 | A | 5/1995 | Kmiecik-Lawrynowicz et al. | |
| 5,580,692 | A | 12/1996 | Lofftus et al. | |
| 5,609,979 | A | 3/1997 | Lawson | |
| 5,702,860 | A | 12/1997 | Koyama et al. | |
| 5,968,702 | A | 10/1999 | Ezenyilimba et al. | |
| 5,968,705 | A | 10/1999 | Yamada et al. | |
| 6,033,822 | A | 3/2000 | Hasegawa et al. | |
| 6,156,473 | A | 12/2000 | Tyagi et al. | |
| 6,190,819 | B1 | 2/2001 | Takahashi et al. | |
| 6,287,742 | B1 | 9/2001 | Yoon | |
| 6,294,595 | B1 | 9/2001 | Tyagi et al. | |
| 6,403,274 | B2 | 6/2002 | Tomita et al. | |
| 6,458,502 | B1 | 10/2002 | Nakamura et al. | |
| 6,482,562 | B2 | 11/2002 | Ezenyilimba et al. | |
| 6,503,677 | B1 | 1/2003 | Gutman et al. | |
| 6,531,255 | B2 | 3/2003 | Kim et al. | |
| 6,582,867 | B2 | 6/2003 | Serizawa et al. | |
| 6,596,453 | B2 | 7/2003 | Fujino et al. | |
| 6,682,866 | B2 | 1/2004 | Sugiyama et al. | |
| 2003/0175609 | A1 * | 9/2003 | Combes et al. | 430/108.22 |
| 2004/0063020 | A1 * | 4/2004 | Stegamat et al. | 430/137.1 |
| 2005/0202334 | A1 * | 9/2005 | Oshiba et al. | 430/120 |

* cited by examiner

*Primary Examiner*—Mark F Huff
*Assistant Examiner*—Rachel L Burney
(74) *Attorney, Agent, or Firm*—Muncy, Geissler, Olds & Lowe, PLLC

(57) ABSTRACT

A method of forming electrophotographic toner. An organic solution containing a polymer resin and a solvent and an aqueous solution containing an anti-coagulant are provided. The aqueous solution is added into the organic solution to form colloidal polymer particles. The colloidal polymer particles are then aggregated, coalesced, and solidified to form toner particles.

9 Claims, 3 Drawing Sheets
(2 of 3 Drawing Sheet(s) Filed in Color)

METHOD OF FORMING ELECTROPHOTOGRAPHIC TONER

BACKGROUND

The present invention relates to a method of forming polymeric particles for use as electrophotographic toners and, more particularly, to a method of controlling particle shape, particle size, and particle size distribution of the toners for high-resolution electrophotographic image development.

In the conventional method of making electrophotographic toner, polymer resin binder and various additives such as colorants, charge control agents, release agents are melt-blended on a hot press roller or in an extruder. The resin mixture is then cooled and solidified, and then ground or pulverized into particles.

The above conventional process has numerous drawbacks including a desired resin brittleness required for pulverization into particles. Low molecular weight resins are typically used to obtain the desired brittleness. Low molecular weight is undesirable, however, due to regarding the following characteristics:

a. low molecular weight resins tend to be in the form of flakes while in use as toners or developers;
b. toner particles made of low molecular weight resins are prone to result in deposition on carriers, which cause poisoning of carrier particles in electrophotographic development;
c. low molecular weight resins have insufficient viscoelastic properties, such that hot-offset is easily formed due to toner sticking to the fuser roller during melting; and
d. thermal properties such as glass transition temperatures of the low molecular weight resins are hard to adjust, control, and keep in the desirable range.

In addition, the conventional method further has the following common problems:

a. pulverization results in a wide distribution of particle sizes, such that the yield of useful toners is low and therefore the manufacturing cost is excessively high;
b. surface features of the particles are coarse and irregular, causing poor printing quality; and
c. particle size is hard to control, and many fine particles are produced by pulverization, causing a shortened service life of the developer due to accumulation of the fine particles on the developer.

To resolve the above-mentioned problems and drawbacks, numerous toner manufacturing processes have been proposed and taught in the art. Many of the improved methods are based on aggregation and coalescence of particles in the solution.

Such processes overcome the drawbacks of the conventional melt-blending and pulverization process and have the following advantages:

a. coalescence can be controlled to obtain uniform shapes, and narrow particle size distribution without forming fine particles;
b. tough resins can be used by the solution coalescence process and thus the choice of usable resins is more accommodating than the conventional method; and
c. toner additives not applicable in the conventional melt blending method due to their decomposition by heat can then be used in the coalescence process.

Typical coalescence processes employ dispersion of polymer solution in an aqueous phase that contains anti-coagulant agent to form fine resin droplets, adjusting the extent of aggregation and coalescence between resin droplets so as to control the sizes and the size distribution for the polymer droplets. The solvent of the polymer droplets is then removed to form solid polymer particles. The process is continued by separation, washing and drying to obtain a narrower distribution of particle sizes compared to the conventional pulverization process.

Three different coalescence processes are disclosed in the prior art relating to particle formation in the solution.

The first method includes using monomers to polymerize and form polymer particles by suspension polymerization or emulsion polymerization in which the dispersion and coalescence techniques are disclosed such as those in U.S. Pat. Nos. 3,959,153, 4,816,366, 5,418,108, 5,702,860, 5,968,705, 6,033,822, 6,190,819, 6,458,502, 6,503,677 and 6,596,453.

This method also has limitations. Special monomers and reaction initiators are required for suspension polymerization and emulsion polymerization. Therefore, the available polymer materials are limited. Currently, this method is only suitable for the styrene-acrylic copolymer system. The polymerization reaction is easily interfered with by other additives such that the degree of polymerization is limited. Unreacted monomers due to the low degree of polymerization can pose serious concerns in safety while handling. This complicates the manufacturing process and special care must be taken to remove the unreacted monomers.

The second method employs heating and melting the polymers instead of using solutions. The polymer resins are liquidized at high temperatures, then dispersed and coalesced in non-solvents as disclosed in U.S. Pat. Nos. 5,609,979, 6,287,742, 6,531,255 and 6,582,867.

In this method, the polymer resins having high melting points are difficult to operate and consume an excessive amount of energy. For resins with melting points higher than 100° C., water cannot be used as the dispersion medium, thus complicating manufacture. Further, waste management costs are increased. In addition, toner additives with insufficient thermal stabilities cannot be used and therefore the applications are limited.

The third method, as disclosed in U.S. Pat. Nos. 4,833,060, 4,835,084, 5,049,469, 5,283,149, 5,298,355, 5,968,702, 6,156,473, 6,294,595, 6,403,274, 6,482,562 and 6,682,866, are related to a solution coalescence process in which a polymer solution is prepared by dissolving a polymer in a solvent.

By this method, a wide range of polymer materials can be selected and the manufacturing process can be simplified, e.g. no monomer residues resulted and no heating at high temperatures is required. This method, however, has the following disadvantages.

First, to control particle size and particle size distribution, a high-speed homogenizer is used to form fine resin droplets and to perform coalescence.

Second, the solvent of the polymer solution has to be removed by evaporation after particle coalescence. Rapid evaporation may disturb the state of coalescence and unexpectedly change the size of the solidified droplets. Thus, evaporation of solvent is a slow, time-consuming process. This prolonged heating and evaporation creates a bottleneck in scaling up the manufacturing process.

Third, during the heating and stirring process, the dispersion stability is easily destroyed, causing agglomeration of coalesced droplets. As a result, the enlarged particles have a very wide distribution and the toner quality cannot be precisely controlled.

To resolve the drawbacks of the third method, U.S. Pat. No. 5,580,692 discloses a solvent extraction method to remove the solvent of coalesced droplets. The solvent extraction method adds a second solvent to extract the solvent contained in the coalesced droplets. Therefore, the organic solvent can be removed without heating. However, the state of solution dispersion may be unstable due to the addition of the second solvent. In addition, the amount of second solvent required for extraction may be excessively voluminous and create problems in waste management.

Based on the above analysis, the third method seems to provide the most advantages in preparing the polymer solution since there is no limitation in material selection. However, this method still has several limitations requiring improvement.

First, to reduce the equipment costs and power consumption, replacing of high-speed, large power-driven homogenizers with common mechanical mixers are desirable.

Second, the efficiency of removing the solvent from the coalesced droplets has to be enhanced without affecting the dispersion stability of the coalesced droplets.

Third, the particle size of the toner must be controlled more precisely to meet a variety of product requirements.

If the fine resin droplets cannot be formed through sufficiently small and stable dispersion, the expected size and size distribution of the particles after coalescence cannot be achieved. In addition, if the solvent cannot be removed in time, the coalesced droplets that have not been solidified will have many agglomerates during subsequent washing and filtering.

As the particle shape, particle size and particle size distribution of toner are all critical to printing quality, particularly for image development requiring high quality gray scales and full color. Particularly, the shape of the toner affects triboelectricity, flowability, cleaning efficiency, packing density and uniformity. Coarse toners such as those prepared by the traditional process have sufficient surface frictions, resulting in high triboelectricity and efficient blade cleaning. However, flowability, packing density and uniformity are inferior in coarse toners. The toner particles with uniform shape and narrow particle size distribution typically have uniform tribocharging and conforming toner stacking to result in high toner transfer efficiency, high print density and excellent print image quality. However, on the other hand, the cleanability and extent of tribocharging become less satisfied if uniformity of toner shape is approached. Different toner sizes result in different triboelectricity values during image development. Small-size toners are easily over-tribocharged, such that the toner transfer for image development becomes insufficient. In addition, non-uniform charging of toner particles may cause printing smear edges or backgrounding. Non-uniform sizes and irregular shapes result in loose stacking of toner layers in image development, thus thicker toner layers are required to give appreciable print density. For toners with regular sizes and shape, the stacking efficiency, image uniformity and color density are better, and thus the required thickness of toner layers is less. Thin toner layers and color uniformity result in better image transparency. Therefore, the print quality can reach a level close to that of offset printing. Conversely, thicker toner layers generate rough image surface and the printed paper is easily curled. Moreover, thinner toner layers are also advantageous in improving fixing efficiencies, such that the power consumption can be reduced and printing speed can be increased.

In brief, the aforementioned coalescence process revealed in the prior art have difficulties in controlling stable dispersion of the polymer colloidal solution. Therefore, the above methods for producing electrophotographic toners are limited by the problem of unsatisfactory control of the toner quality. A new method is thus required to produce uniform and high quality electrophotographic toners, so as to improve the efficiency of coalescence processes, and to provide better adjustment and control of particle shape, particle sizes and size distribution.

SUMMARY

The invention provides a novel coalescence method to improve the above-mentioned drawbacks such as use of high-shear agitators or homogenizers. Moreover, solvent trapped in polymer particles can be quickly removed without affecting dispersion stability.

The invention provides a method of forming electrophotographic toner. An organic solution containing a polymer resin and a solvent and an aqueous solution containing an anti-coagulant are provided. The aqueous solution is added into the organic solution to form colloidal polymer particles. The colloidal polymer particles are then aggregated, coalesced, and solidified to form toner particles.

Shapes, sizes, and size distribution of the polymer particles are controlled by adjusting compatibility between the organic solution and the aqueous solution and changing amounts of the anti-coagulant.

A detailed description is given in the following examples with reference to the accompanying drawings.

BRIEF DESCRIPTION OF THE DRAWINGS

The patent or application file contains at least one drawing executed in color. Copies of this patent or patent application publication with color drawing(s) will be provided by the office upon request and payment of the necessary fee.

The invention can be more fully understood by reading the subsequent detailed description and examples with references made to the accompanying drawings, wherein.

DETAILED DESCRIPTION

Figure 1:
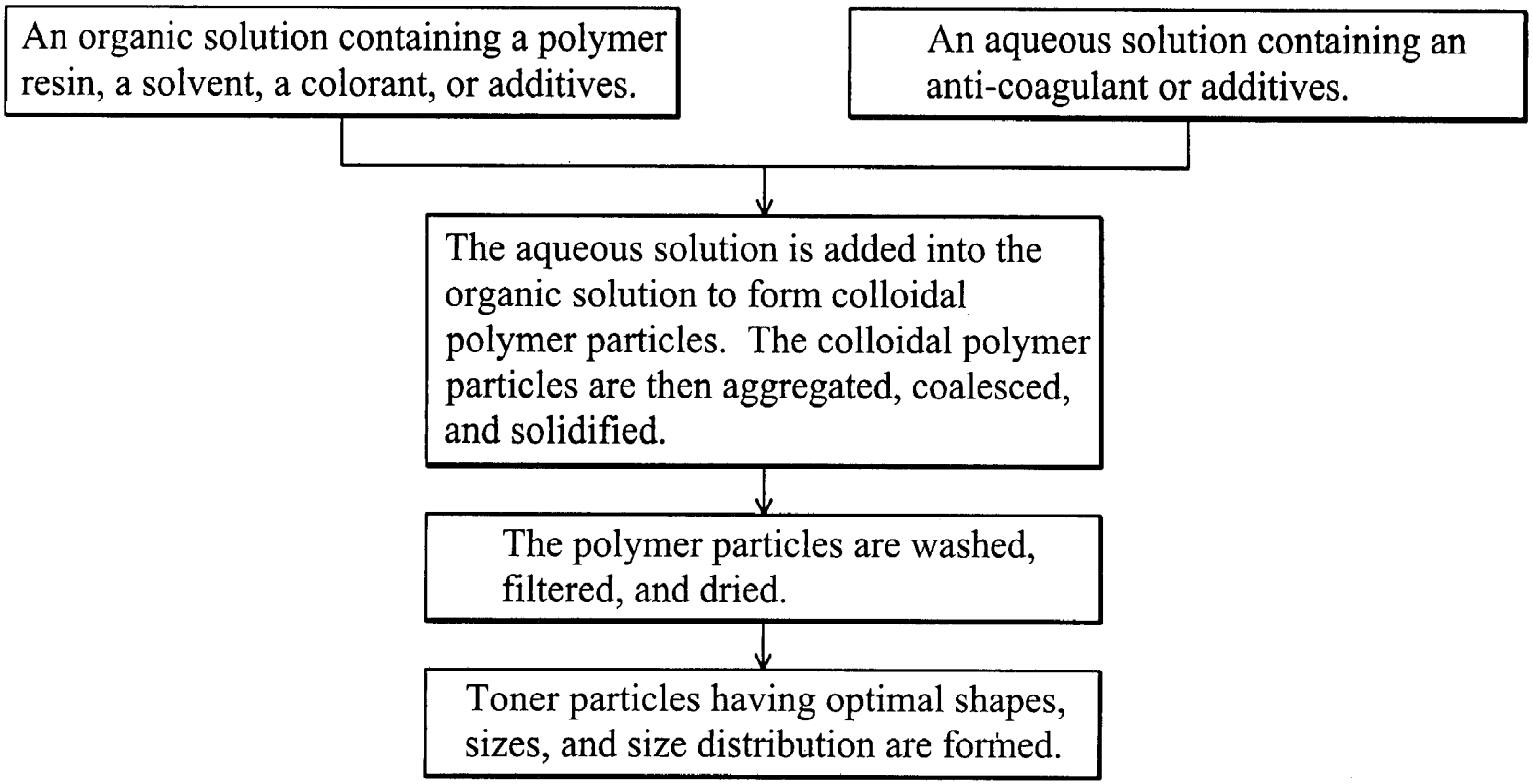
FIG. 1 shows a flowchart of toner preparation procedures.

Commonly known pigments and dyes may be used as the colorant in the present invention. Popular colorants include black pigments (carbon black and ferric oxide), blue pigments (C.I. pigment Blue 7, 60, 62, 66, 15:1, 15:2, 15:3 and 15:4), red pigments (C.I. Pigment Red 2, 6, 48:1, 48:2, 48:3, 48:4, 57:1, 81, 122, 146, 184 and 221) and yellow pigments (C.I. Pigment Yellow 12, 13, 14, 15, 17, 74, 83, 97, 136, 150, 151, 174 and 185). Suitable dyes include dispersible dyes and oil-base dyes incompatible with aqueous phase. The relative weight of the colorant to the resin is about 1-15 wt %, and preferably between 2-10 wt %. The particle size of the insoluble colorants is about 0.01 to 1 μm, preferably between 0.05 and 0.5 μm.

The release agents of the present invention are used for imparting good fixing properties to the toner at low temperatures, good resistance to offset and good durability. Commonly used release agents include silicon oil, paraffin, polyethylene wax, polypropylene wax, fatty acid wax, ester wax, long-chain alcohol, long-chain acid, animal wax, plant wax or other synthetic wax. The relative weight of the release agent to the resin is about 0 to 20 wt %, and preferably 0-10 wt %.

The operation temperature of the release agent depends on the specific requirements of the electrostatic development device, typically around 60° C. to 130° C.

The charge control agents of the present invention have a high charging speed and also maintain a high charge level. Commonly known charge control agents include quaternary ammonium salts, salicylic acid complex, azo metal complex, aromatic carboxylic complex and derivatives thereof. The weight percentage of the charge control agent to the resin is about 0 to 20 wt %, and preferably 0-10 wt %.

The present invention is applicable to many types of polymers that are capable of being dissolved in an organic solvent, but are immiscible with water. These polymers include, for example, polyamides, polyesters, acrylic resins, polystyrenes, epoxy resins, styrene-acrylate copolymers, polyolefins, polycarbonate, polyacrylamide, ethylene-vinyl acetate, polyvinyl acetate, polyurethane, polyvinyl butyral and the copolymer or a mixture of the above. The weight percentage of the polymer in the toner is about 50-95 wt %, and preferably 70-90 wt %.

Any suitable solvent that can dissolve the polymer and is also at least partially water-soluble may be used in the practice of this invention. The solvents include, for example, methanol (MeOH), ethanol, n-propanol, iso-propanol (IPA), n-butanol (BuOH), iso-butanol, tert-butanol, glycerol, ethylene glycol, methyl acetate(MAc), ethyl acetate (EAc), Propyl acetate(PAc), butyl acetate(BAc), propylene glycol monomethyl ether acetate(PMA), butyl cellosolve(BCS), ethyl formate, acetone, methyl ethyl ketone (MEK), methyl isobutyl ketone (MIBK), cyclohexanone(CYC), tetrahydrofuran (THF), dioxane, dichloromethane, dichloroethane, chloroform and a mixture of the above.

The miscibility of the solvent in water is an important parameter for the kinetics of polymer phase separation and colloidal solidification. Solvents highly miscible with water allow water to easily extract the solvent from the organic phase, thereby accelerating phase separation and colloidal solidification. If phase separation proceeds too quickly, colorless particles are generated without including the colorant in the particles. In this case, polymer droplets cannot encapsulate pigments or other additives because polymer particles separate out of the solution separately. Solvents slightly miscible with water allow the aqueous phase to slowly extract the solvent from the organic phase, thereby decreasing the rate of phase separation and colloidal solidification. Large particles are obtained when polymer droplets solidify slowly. In this case, the slowly solidified polymer droplets are allowed to agglomerate to form large particles. In other words, the extent of miscibility between the solvent and water determines the rate of phase separation and solidification of polymer colloids, thereby provides a means to control the particle shape, sizes and size distribution. Moreover, the solid content of the polymer resin in the organic phase is critical to the degree of supersaturation, and thereby the number of nuclei formed when phase separation occurs is affected. As a result, a high solid content is prone to form large particles with a wide distribution because of the high nucleation rate during phase separation. Conversely, a low solid content is inefficient for particle formation because the nucleation rate is slow and the frequency of the coalescence between particles is also low during phase separation. The suitable solubility of the organic solvent is at least 0.01 gram of organic solvent dissolved in water, and preferably 0.04-1 gram per gram of water. The suitable solid content of the polymer resin in the organic phase is 10-90 wt %, and more preferably in the range of 20-80 wt %.

The anti-coagulant of the present invention is used to perform two important functions. First, it prevents excessive agglomeration of the polymer colloidal droplets during phase separation. In the invention, the aqueous phase induces spontaneous phase separation to form sub-micron polymer droplets. Thus, in the absence of the anti-coagulant, the droplets tend to coalesce in an uncontrollable manner, producing large particles. Second, the amount of anti-coagulant directly controls the degree of aggregation-coalescence of colloid droplets. In other words, the anti-coagulant concentration can affect the particle sizes and size distribution of toner. The commonly used anti-coagulant includes cationic, anionic or non-ionic surfactant, water-soluble polymer, and inorganic ultra-fine oxide powder. The preferable anti-coagulant is non-ionic surfactant, or water-soluble polymer, or inorganic ultra-fine solid powder.

Examples of usable anti-coagulant of polymer include polyvinyl alcohol (PVA), polyvinylpyrrolidone (PVP), methyl cellulose, ethyl cellulose, hyroxypropyl cellulose, hydroxyethyl methyl cellulose, hydroxypropyl ethyl cellulose, carboxymethyl cellulose (CMC) and its salts such as CMC-Na, hydroxyethyl cellulose (HEC), polyacrylic acid and its salts, polyacrylic amide, polystyrene sulfonate, acacia gum, copolymer of ethylene oxide and propylene oxide(PEO-PPO), and a mixture of the above. In the aqueous phase, the polymeric anti-coagulant has a weight percentage around 0.1-30 wt %, and preferably 1-20 wt %.

The commonly used anti-coagulant of surfactants include ionic-type alkylsulfate, alkylsulfonate, alkylnaphthalenesulfonate, fatty acid salt, alkylphosphate, alkylaminoate; non-ionic-type alkylpolyoxyethylene ether, alkylpolyphenol ethoxylate, alkylolamide, Tween, Span, and a mixture thereof. In the aqueous phase, the weight percentage of the surfactant is about 0-10 wt %, and preferably 0-5 wt %.

The anti-coagulant of inorganic powders such as silica powder, alumina powder, titania powder, calcium carbonate powder, and a mixture of the above are commonly used for stabilizing polymer colloidal droplets. The particle size of inorganic powder is about 0.001-1 μm, and preferably between 10-40 nm.

The anti-coagulant is usually a surface active matter, easily adsorbed on the surface of polymer particles in the aqueous phase. The anti-coagulant is able to suppress agglomeration of polymer particles by increasing solution viscosity, electrostatic repulsion between particles, and providing spatial obstacles for aggregation between particles. Furthermore, the surface active properties of anti-coagulant can decrease interface energy between the organic and aqueous phases, and thereby effecting phase separation. The decreased interface energy between the organic and aqueous phases favors the formation of small colloid droplets as phase separation occurs. Generally speaking, polymeric anti-coagulant is effective in suppressing agglomeration, while surfactants tend to facilitate phase separation due to the strong surface activity. The higher concentration of anti-coagulant is added to the aqueous phase, the smaller sizes and narrower size distribution are produced. However, too much anti-coagulant causes the polymer colloid particles to not coalesce and results in an excess of fine particles, posing difficulties in subsequent washing and filtering operations. On the contrary, low anti-coagulant concentration will result in larger particles. The amount of anti-coagulant has an optimal concentration called saturated absorption concentration, beyond which further added anti-coagulant becomes redundant.

The aqueous phase of the invention includes water and anti-coagulant. Water is used to extract the organic solvent from the resin solution and therefore increase the super-saturation level of the resin which provides a driving force for particle formation. Therefore, the aqueous phase has to be soluble or partially soluble with the organic solvent, but unable to dissolve the resin, such that the organic solvent can be effectively removed from the resin solution. It is necessary to avoid excessively fast extraction of the solvent for fear of forming large particles. Therefore, the amount and the rate of the aqueous phase added, and the time allowed for aggregation/coalescence all have to be controlled in accordance with the specific system. The proper amount of aqueous phase is typically 0.5 to 10 times the amount of organic phase, and preferably in the range of 1-5 times. The adding rate of the aqueous phase has an influence on the super-saturated concentration of the polymer resin, which is in turn correlated with the nucleation rate of the particles. Therefore, when the adding time is too long (when the adding rate is too slow), the coalescence among colloidal particles proceeds at different paces such that the particle size distribution is broadened. On the other hand, if the adding rate of the aqueous phase is too fast, gelation and agglomeration in the resin solution will occur due to excessive nucleation. The appropriate adding time of the aqueous phase is about 0-120 minutes, and preferably 0.5-60 minutes, to afford a narrow size distribution of particles. The aggregation/coalescence time, or the so-called aging time, is the time required for achieving and sustaining stable sizes and stable size distribution of particles. The appropriate aggregation/coalescence time is about 1-240 minutes, and preferably 1-120 minutes.

The obtained toner particles are subsequently washed with water to remove the anti-coagulant and the residual solvent. The toner particles are then separated by filtering and dried by vacuum oven. Additives such as the charge control agent, anti-blocking agent and flow agent can be added to the dried toner particles to meet the requirements of electrophotographic devices.

The main differences between the present invention and the previously disclosed coalescent processes lie in the mechanism of forming primary colloidal particles and the method for removing solvents from the colloidal particles. Adding the aqueous phase into the organic phase facilitates the extraction of the solvent, thereby decreasing the solubility and increasing super-saturated concentration of the resin in the organic phase. When the super-saturated concentration of the resin exceeds the critical nuclei concentration, the resin is excluded from the solution to form primary colloidal particles. This results in a spontaneous phase separation. Such a spontaneous process does not require high-shear agitation devices to form primary colloidal particles as revealed in the previously disclosed techniques. The previously disclosed coalescent processes often require a high-speed agitation of 6000-20000 rpm. To the contrary, the inventive coalescent process only requires an agitation speed of 400-300 rpm, and preferably 600-200 rpm. In addition, during dispersion and aggregation/coalescence of the colloidal particles, the solvent trapped in the colloids is easily extracted and removed to the aqueous phase without heating or adding a second extraction solvent. The conventional coalescence process requires heating and evaporation to remove solvents from the polymer particles and the prolonged heating may destroy the dispersion stability. Therefore, the present invention offers a significantly improved method for obtaining a stable and uniform size distribution. Furthermore, the conventional process takes about 8-24 hours to complete the process, whereas the process of the invention requires only about 1-240 minutes in which a processing time of 1-120 minutes is preferable.

In the aspect of controlling particle shape, sizes and size distribution, the conventional coalescence processes used anti-coagulant to control the aggregation and coalescence of the primary colloidal particles. As a result, large toner particles are obtained when aggregation and coalescence are extensive, while small toner particles are obtained when aggregation and coalescence are limited. In addition to the usage of anti-coagulant, the present invention controls particle sizes by adjusting the rates of phase separation and particle solidification. Therefore, when the polymer is separated from the solution to form uniform colloidal particles, a narrow size distribution of particles is obtained. On the other hand, when the solidification rate is fast, the particle sizes are small. By the method of the invention, the volume-averaged particle size of the toner, $D_v$, can be controlled to be in the range of 3-15 μm, and the corresponding number-averaged particle size, $D_p$, is in the range of 2-12 μm. The size distribution of the particles, $D_v/D_p$, is extremely sharp and can be well controlled at about 1.3. In addition, the shapes of the toner particles can be varied in a wide range from regular spherical to irregular non-spherical.

The electrophotographic toner can be used in a xerographic device such as a laser printer, a copy machine, a fax machine or a multi-function business machine.

EXAMPLE 1

225.5 g of styrene-acrylic resin (P581, supplied by SEKISUI Chemical), 110 g of methyl ethyl ketone (MEK), 220 g of ethyl acetate and 27 g of releasing wax (Licowax S, supplied by Clariant) are heated and dissolved in a 1000 ml container to prepare the polymer solution. The polymer solution is then poured into a shaker bottle. After the solution is cooled, 13.5 g of cyan colorant (PB 15:3, supplied by Janie Color Works), 4 g of CCA (E84, supplied by Orient Chemical) and 300 g of glass beads with a size of 1 mm in diameter are added to the shaker bottle. Using a paint shaker machine, the mixture is blended and dispersed for 2 days. The glass beads are then removed to obtain the organic phase, a cyan polymer solution. The concentrations of the resin, releasing wax, colorant and CCA are 37.55 wt %, 4.5 wt %, 2.25 wt % and 0.7 wt %, respectively, and the total solid content is 45 wt %.

In a 500 ml container, 15 g of polyvinyl alcohol (PVA BC20, supplied by Chang Chun Plastics), 2 g of Tween 20 and 178 g of water are heated and blended until the PVA is dissolved. The solution is cooled to room temperature to result in the aqueous phase. The concentrations of PVA and Tween 20 are 7.5 wt % and 1 wt %, respectively.

30 g of polymer solution of the organic phase is poured into an aggregation-coalescence tank and agitated at 1200 rpm under room temperature. 60 g of the aqueous phase is added to the aggregation-coalescence tank with a constant adding rate and simultaneous blending with the organic phase. The resin of the organic phase is separated from the solution and becomes a uniform dispersion of colloidal particles. The adding time of the aqueous phase is 50 seconds. The mixture is continuously stirred for 10 minutes until aggregation-coalescence of colloidal particles are completed. Water in the amount of three times the organic phase is then added to accelerate the solidification of the polymer particles.

The polymer particles obtained by the above process is then isolated and washed by water several times, followed by vacuum drying to obtain the toner particles. FIG. 1 depicts a flow chart for the preparation procedures described in Example 1.

EXAMPLE 2

In this example, the method of preparing the organic phase, the aqueous phase and the aggregation-coalescence process are similar to those in example 1. However, the resin used for the organic phase is changed to acrylic resin (DM55, supplied by ROHM & HAAS). The compositions are listed in Tables 1 and 2, and the related operating parameters are listed in Table 3.

EXAMPLE 3

In this example, the method of preparing the organic phase, the aqueous phase and the aggregation-coalescence process are similar to those in example 1. However, the resin used for the organic phase is changed to copolyamide (VESTAMELT 171, supplied by Degussa). The compositions are listed in Tables 1 and 2, and the related operating parameters are listed in Table 3.

EXAMPLE 4

In this example, the method of preparing the organic phase, the aqueous phase and the aggregation-coalescence process are similar to those in example 1. However, the resin used for the organic phase is changed to a mixture of styrene-acrylate resins of P581 and CPR-100 (CRP-100, supplied by MITSUI) with a weight ratio of about 4 to 1. The compositions are listed in Tables 1 and 2, and the related operating parameters are listed in Table 3.

EXAMPLE 5

In this example, the method of preparing the organic phase, the aqueous phase and the aggregation-coalescence process are similar to those in example 1. However, the concentration of the anti-coagulant, PVA, in the aqueous phase is changed to 10 wt %. The detailed ingredients of the organic phase and aqueous phase are listed in Tables 1 and 2, and the related operating parameters are listed in Table 3.

EXAMPLE 6

In this example, the method of preparing the organic phase, the aqueous phase and the aggregation-coalescence process are similar to those in example 5. However, the ratio of MEK to EAc used for the organic solvent is changed to 10:9. The compositions are listed in Tables 1 and 2, and the related operating parameters are listed in Table 3.

EXAMPLE 7

In this example, the method of preparing the organic phase, the aqueous phase and the aggregation-coalescence process are similar to those in example 6. However, the time for adding the aqueous phase into the organic phase is shortened to 30 seconds. The detailed ingredients of the organic phase and aqueous phase are listed in Tables 1 and 2, and the related operating parameters are listed in Table 3.

EXAMPLE 8

In this example, the method of preparing the organic phase, the aqueous phase and the aggregation-coalescence process are similar to those in example 7. However, the concentration of the anti-coagulant, PVA, in the aqueous phase is changed to 7.5 wt %. The detailed ingredients of the organic phase and aqueous phase are listed in Tables 1 and 2, and the related operating parameters are listed in Table 3.

EXAMPLE 9

In this example, the method of preparing the organic phase, the aqueous phase and the aggregation-coalescence process are similar to those in example 1. However, the operating parameters of the aggregation-coalescence process are different. The detailed ingredients of the organic phase and aqueous phase are listed in Tables 1 and 2, and the related operating parameters are listed in Table 3.

EXAMPLE 10

In this example, the method of preparing the organic phase, the aqueous phase and the aggregation-coalescence process are similar to those in example 9. However, the time for adding the aqueous phase into the organic phase is lengthened to 110 seconds. The detailed ingredients of the organic phase and aqueous phase are listed in Tables 1 and 2, and the related operating parameters are listed in Table 3.

EXAMPLE 11

In this example, the method of preparing the organic phase, the aqueous phase and the aggregation-coalescence process are similar to those in example 1. However, the solid content of the organic phase is changed to 50 wt %. The detailed ingredients of the organic phase and aqueous phase are listed in Tables 1 and 2, and the related operating parameters are listed in Table 3.

EXAMPLE 12

In this example, the method of preparing the organic phase, the aqueous phase and the aggregation-coalescence process are similar to those in example 1. However, the solid content of the organic phase is changed to 40 wt %. The detailed ingredients of the organic phase and aqueous phase are listed in Tables 1 and 2, and the related operating parameters are listed in Table 3.

EXAMPLE 13

In this example, the method of preparing the organic phase, the aqueous phase and the aggregation-coalescence process are similar to those in example 9. However, the formula of the organic phase is different. The detailed ingredients of the organic phase and aqueous phase are listed in Tables 1 and 2, and the related operating parameters are listed in Table 3.

TABLE 1

| | Organic solution composition | | | | | | | | | | |
|---|---|---|---|---|---|---|---|---|---|---|---|
| Ex. | Polymer resin | wt % | Org. solvent | ratio | colorant | wt % | CCA | wt % | wax | wt % | Solid cont. |
| 1 | P581 | 37.55 | MEK/EAc | 1/2 | PB15:3 | 2.25 | E84 | 0.7 | Wax S | 4.5 | 45.0 |
| 2 | DM55 | 28.5 | IPA/ BuOH | 4/1 | PR-122 | 1.5 | — | 0.0 | — | 0.0 | 30.0 |
| 3 | VESTA-MELT171 | 19 | Methanol/ butanol | 2/1 | PR-122 | 1 | — | 0.0 | — | 0.0 | 20.0 |
| 4 | P581/ CPR100 | 42.5 | MEK/EAc | 3/4 | PB15:3 | 2.5 | — | 00. | Wax S | 5.0 | 50.0 |
| 5 | P581 | 37.55 | MEK/EAc | 1/2 | PB15:3 | 2.25 | E84 | 0.7 | Wax S | 4.5 | 45.0 |
| 6 | P581 | 37.55 | MEK/EAc | 10/9 | PB15:3 | 2.25 | E84 | 0.7 | Wax S | 4.5 | 45.0 |
| 7 | P581 | 37.55 | MEK/EAc | 1/2 | PB15:3 | 2.25 | E84 | 0.7 | Wax S | 4.5 | 45.0 |
| 8 | P581 | 37.55 | MEK/EAc | 1/2 | PB15:3 | 2.25 | E84 | 0.7 | Wax S | 4.5 | 45.0 |
| 9 | P581 | 37.55 | MEK/EAc | 1/2 | PB15:3 | 2.25 | E84 | 0.7 | Wax S | 4.5 | 45.0 |
| 10 | P581 | 37.55 | MEK/EAc | 1/2 | PB15:3 | 2.25 | E84 | 0.7 | Wax S | 4.5 | 45.0 |
| 11 | P581 | 41.75 | MEK/EAc | 3/4 | PB15:3 | 2.5 | E84 | 0.75 | Wax S | 5.0 | 50.0 |
| 12 | P581 | 33.4 | MEK/EAc | 2/5 | PB15:3 | 2.0. | E84 | 0.6 | Wax S | 4.0 | 40.0 |
| 13 | P581 | 33.4 | MEK/EAc | 3/4 | PB15:3 | 2.0 | E84 | 0.6 | Wax S | 4.0 | 40.0 |

TABLE 2

| | Aqueous solution composition | | | |
|---|---|---|---|---|
| Example | Anti-coagulant | wt % | Surfactant | wt % |
| 1 | PVA | 7.5 | Tween20 | 1 |
| 2 | PVA | 5 | — | 0 |
| 3 | PVA | 4.5 | DowFAX2A1 | 4 |
| 4 | PVA | 7.5 | Tween20 | 1 |
| 5 | PVA | 10 | Tween20 | 1 |
| 6 | PVA | 10 | Tween20 | 1 |
| 7 | PVA | 10 | Tween20 | 1 |
| 8 | PVA | 7.5 | Tween20 | 1 |
| 9 | PVA | 7.5 | Tween20 | 1 |
| 10 | PVA | 7.5 | Tween20 | 1 |
| 11 | PVA | 10 | Tween20 | 1 |
| 12 | PVA | 10 | Tween20 | 1 |
| 13 | PVA | 7.5 | Tween20 | 1 |

TABLE 3

| | Parameters | | | |
|---|---|---|---|---|
| Example | Organic solution (g) | Aqueous solution (g) | Adding aqueous solution time (sec) | aggregation-coalescence time (min) |
| 1 | 30 | 60 | 50 | 10 |
| 2 | 25 | 30 | 40 | 2 |
| 3 | 25 | 30 | 40 | 2 |
| 4 | 30 | 60 | 80 | 10 |
| 5 | 30 | 60 | 70 | 10 |
| 6 | 30 | 60 | 70 | 10 |
| 7 | 30 | 60 | 30 | 10 |
| 8 | 30 | 60 | 30 | 10 |

TABLE 3-continued

| | Parameters | | | |
|---|---|---|---|---|
| Example | Organic solution (g) | Aqueous solution (g) | Adding aqueous solution time (sec) | aggregation-coalescence time (min) |
| 9 | 40 | 80 | 60 | 10 |
| 10 | 40 | 80 | 110 | 10 |
| 11 | 30 | 60 | 60 | 10 |
| 12 | 30 | 60 | 60 | 10 |
| 13 | 40 | 80 | 60 | 10 |

COMPARATIVE EXAMPLE 1

Figure 2:
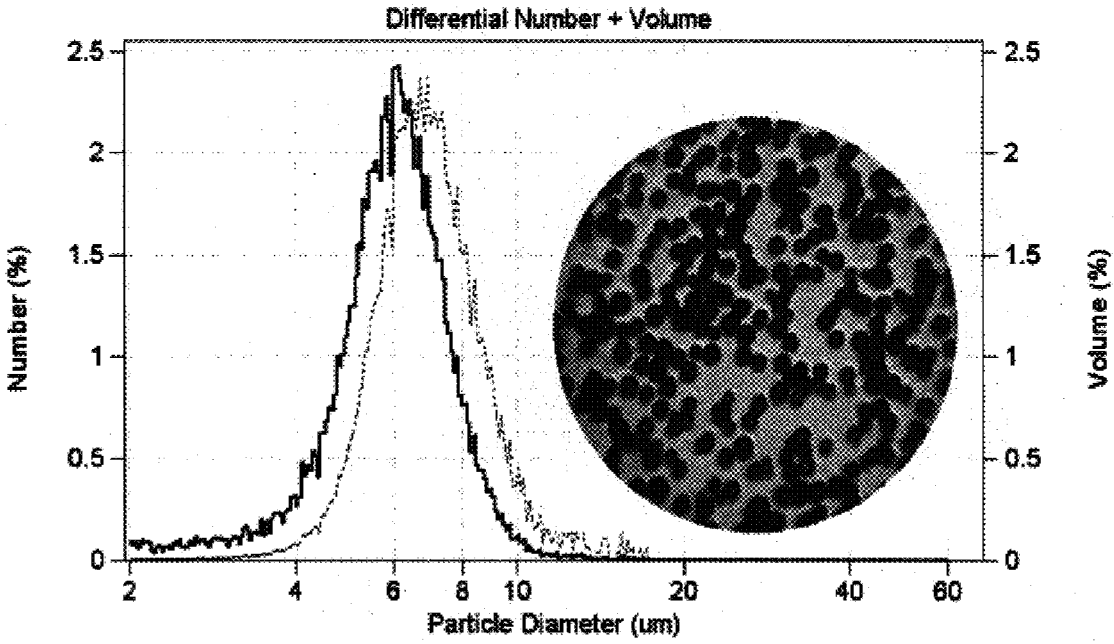
FIG. 2 shows a toner shape and size distribution of comparative example 1.

The shape, sizes and size distribution of the toner particles prepared by the previously disclosed coalescence process are illustrated in FIG. 2, which depicts the features of the toner used in CLJ2500 color laser printer.

COMPARATIVE EXAMPLE 2

Figure 3:
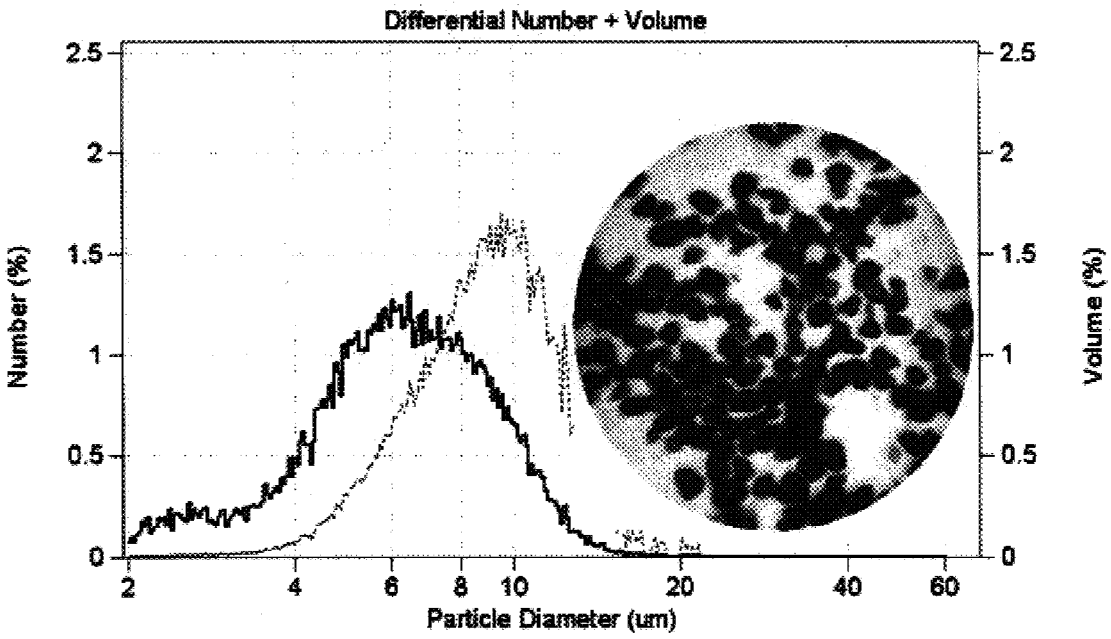
FIG. 3 shows a toner shape and size distribution of comparative example 2.

The shape, sizes and size distribution of the toner particles prepared by the previously disclosed pulverization process are illustrated in FIG. 3, which depicts the features of the toner used in AcuLaser C900 color laser printer.

COMPARATIVE EXAMPLE 3

The shape, sizes and size distribution of the toner particles prepared by the previously disclosed coalescence process are illustrated in Table 4, which describes the features of the toner used in CLJ3500 color laser printer.

TABLE 4

| example | Polymer resin | shape | Dv (μm) | Dp (μm) | Dv/Dp | <4 μm Dv, Dp (%) | >15 μm Dv, Dp (%) |
|---|---|---|---|---|---|---|---|
| 1 | P581(SEKISUI) | regular | 7.3 | 6.2 | 1.18 | 1.0 | 0.2 |
| | | spherical | | | | 6.9 | 0.01 |
| 2 | DM55(ROHM& | regular | 17.5 | 12.2 | 1.43 | 0.1 | 66.7 |
| | HAAS) | spherical | | | | 8.6 | 28.2 |

TABLE 4-continued

| example | Polymer resin | shape | Dv (μm) | Dp (μm) | Dv/Dp | <4 μm Dv, Dp (%) | >15 μm Dv, Dp (%) |
|---|---|---|---|---|---|---|---|
| 3 | VESTAMELT 171(DEGUSSA) | regular<br>spherical | 11.4 | 7.8 | 1.46 | 0.4<br>10.9 | 15.2<br>1.9 |
| 4 | P581(SEKISUI)/ CPR100(MITSUI) | regular<br>spherical | 10.2 | 8.5 | 1.20 | 0.2<br>6.0 | 1.7<br>0.3 |
| 5 | P581(SEKISUI) | regular<br>spherical | 6.4 | 5.3 | 1.21 | 3.5<br>16.7 | 0.14<br>0.01 |
| 6 | P581(SEKISUI) | regular<br>spherical | 8.5 | 5.8 | 1.47 | 2.8<br>27.2 | 0.5<br>0.04 |
| 7 | P581(SEKISUI) | regular<br>spherical | 7.2 | 5.7 | 1.26 | 2.3<br>16.6 | 0.3<br>0.01 |
| 8 | P581(SEKISUI) | regular<br>spherical | 8.5 | 6.7 | 1.27 | 1.0<br>11.8 | 0.4<br>0.03 |
| 9 | P581(SEKISUI) | regular<br>non-spherical | 8.1 | 6.3 | 1.29 | 1.49<br>15.7 | 0.2<br>0.02 |
| 10 | P581(SEKISUI) | regular<br>spherical | 7.6 | 6.5 | 1.17 | 0.6<br>5.1 | 0.3<br>0.02 |
| 11 | P581(SEKISUI) | regular<br>spherical | 10.1 | 7.8 | 1.29 | 0.5<br>11.7 | 2.4<br>0.38 |
| 12 | P581(SEKISUI) | regular<br>spherical | 8.9 | 6.8 | 1.31 | 1.1<br>14.2 | 1.1<br>0.11 |
| 13 | P581(SEKISUI) | regular<br>non-spherical | 11.2 | 8.2 | 1.37 | 1.7<br>8.5 | 10.2<br>0.33 |
| Comparative Example 1 | CLJ2500 | regular<br>spherical | 7.1 | 6.2 | 1.15 | 0.9<br>7.0 | 0.6<br>0.04 |
| Comparative Example 2 | AcuLaser C900 | irregular<br>non-spherical | 9.1 | 6.6 | 1.38 | 1.1<br>13.4 | 2.1<br>0.19 |
| Comparative Example 3 | CLJ3500 | regular<br>spherical | 7.4 | 6.2 | 1.19 | 1.2<br>9.5 | 0.2<br>0.05 |
| Comparative Example 4 | CLJ4600 | regular<br>spherical | 7.8 | 6.6 | 1.18 | 0.6<br>6.1 | 0.8<br>0.06 |

COMPARATIVE EXAMPLE 4

The shape, sizes and size distribution of the toner particles prepared by the previously disclosed coalescence process are illustrated in Table 4, which describes the features of the toner used in CLJ4600 color laser printer.

Toner Size Analysis:

The sizes and size distribution of particles prepared by the current coalescent process are measured by the particle size analyzer of Multiaizer™ 3 (supplied by Beckman Counter). A 100 μm aperture tube is used for measuring the particle sizes, and the measurable range is about 2 to 60 μm. The particle sizes were measured according to the following procedures. A beaker with 60-70% full of standard liquid of ISOTON II (supplied by Beckman Counter) was provided to perform background correction. A diluted solution was dripped into the standard solution to a concentration of about 10%. A total of thirty thousand toner particles were measured. The testing time, depending on the concentration of the solution, was about 5-20 seconds. The analysis results were indicated as volume-averaged or number-averaged particle diameters.

Toner Shape:

The shape of toner particles prepared by the invention as described in above examples was observed by an optical microscope. Prior to the measurement, the toner particles were diluted and evenly spread on a glass slide. The glass slide with the dry toner particles was then loaded on the platform of the microscope. The CCD image was obtained and transferred to a computer for analysis.

Results of the Measurements:

The shape, sizes and size distribution of particles prepared by the aforementioned examples are shown in Table 4.

Figure 4:
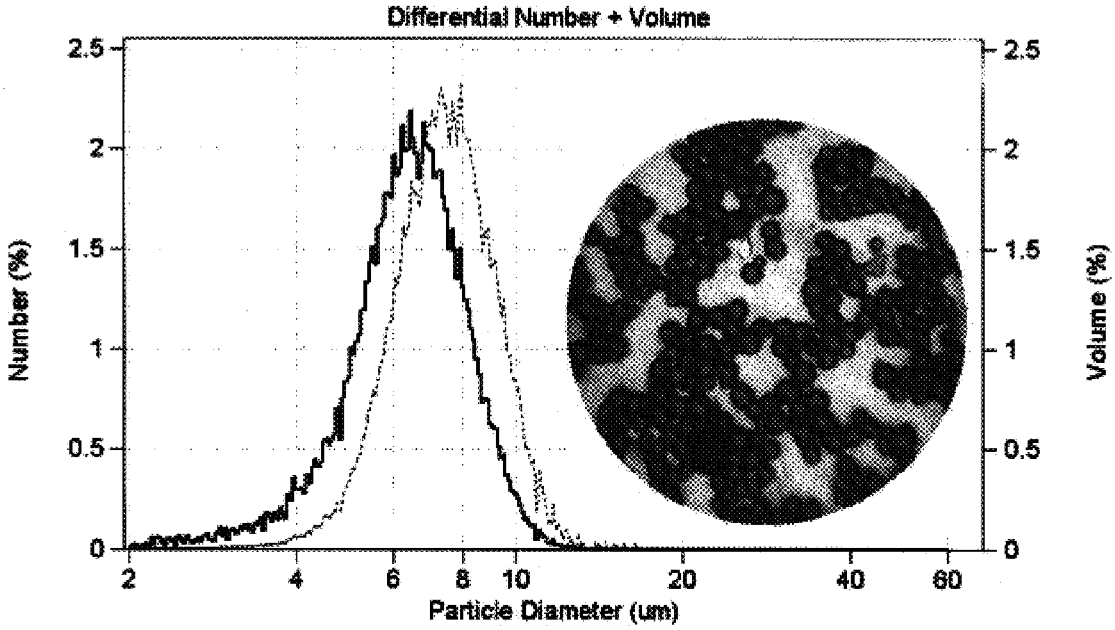
FIG. 4 shows a toner shape and size distribution of example 10.

The particle diameters of toner particles obtained by Examples 1, 5, 7 and 10 are very similar to that prepared by Comparative Examples 1, 3 and 4. However, compared to the toner in Comparative Example 2 which is a pulverized toner, the toners in this invention have smaller particle diameters and narrower distribution of particle sizes as shown in FIG. 4.

Figure 5:
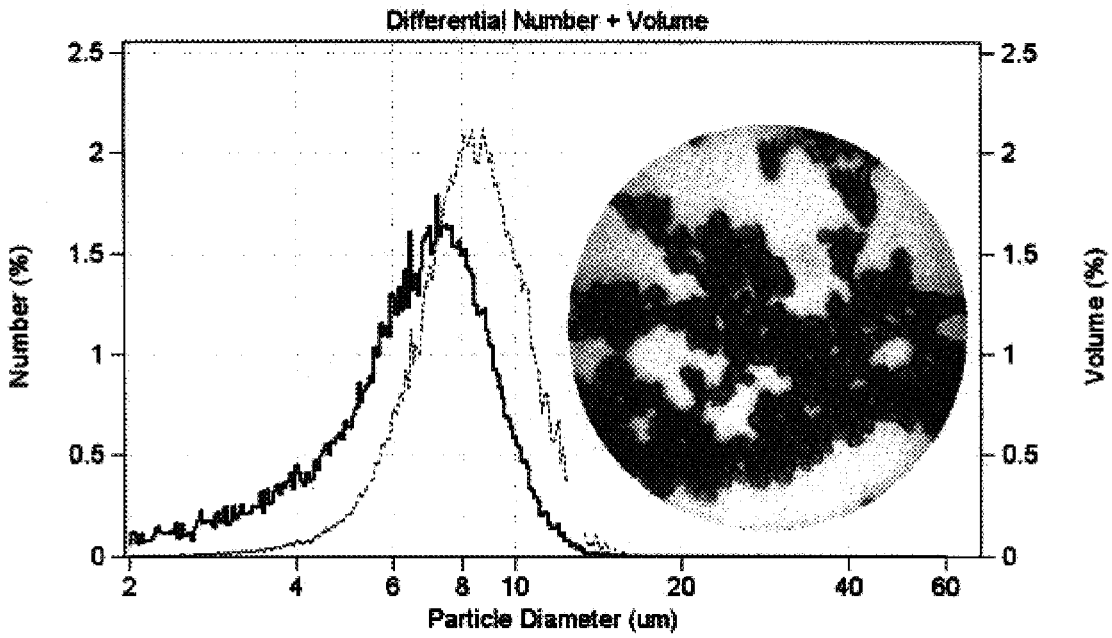
FIG. 5 shows a toner shape and size distribution of example 9.

According to Example 9 and 13, the coalescence method of the invention can also produce non-spherical toner particles which are shown in FIG. 5. By comparison, such non-spherical particles cannot be obtained by the conventional coalescence methods such as the suspension polymerization and polymer dispersion methods.

The aggregation-coalescence process described in Examples 1, 2, 3 and 4 shows that different polymer resins or a mixture of several resins are suitable for use in the invention. The comparison of the results in Examples 5 and 6 shows that the miscibility of organic solvent with water is critical to the aggregation-coalescence process in this invention. For example, as shown in Table 4, phase separation and solidification can be controlled by careful selection of an organic solvent with appropriate water miscibility, thus reducing the sizes and sharpening the size distribution. An inadequate amount of organic solvents may cause the polymer resin and the additives to solidify separately during phase separation and thus produce particles that are colorless, not encapsulated, and overly agglomerated. Typically, suitable solubilities of the organic solvent to the aqueous phase are at least 0.01 g/1 g, and preferably in the range of 0.04 g/1 g to 1 g/1 g.

Regarding the solubility of the polymer resin, solvents of high dissolving capabilities are preferable.

As shown in Example 1 with Example 5, or Example 7 with Example 8, different concentrations of the anti-coagulant cause significant differences. As shown in Table 4, higher anti-coagulant concentrations will result in smaller sizes and narrower distribution. However, excessive anti-coagulant concentration will prevent polymer colloidal particles from coagulating, causing difficulties in washing and filtering of the particles.

Comparisons of the results of Example 1 with Example 8, Example 5 with Example 7, or Example 9 with Example 10 show the effects of the time for adding the aqueous phase (Table 4). Proper controls of the adding time for the aqueous phase result in a sharpened particle-size distribution. When the adding time is too long (slow adding rate), the extents of coalescence between the colloidal particles are largely deviated and a broadened size distribution is produced as a result. When the adding time is too short (adding rate too fast), too many nuclei are formed to cause gelation or over-agglomeration.

Comparisons of Examples 11 and 12, as shown in Table 4, indicate that low solid concentrations are preferred for small particle sizes and narrow size distribution. However, low solid concentrations are not favorable because the production yield is reduced at the same time. Therefore, it is necessary to control the solid concentration of the polymer resin.

The shapes, sizes, and size distribution of particles can be effectively controlled by adjusting various operating parameters such as the anti-coagulant concentration, and the amount or the adding rate of the aqueous solution as discussed above. Thus, high quality toner particles can be obtained and applied in various electrophotographic devices.

While the invention has been described by way of example and in terms of preferred example, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method of forming electrophotographic toner, comprising:

providing an organic solution containing a polymer resin and a solvent, wherein the solvent has a solubility of about 0.04 to 1 g/1g to water;

providing an aqueous solution containing an anti-coagulant, wherein the anti-coagulant is present in an amount of 0.1-30 wt% of the aqueous solution, and the aqueous solution is 0.5 to 10 times the amount of the organic solution;

adding the aqueous solution into the organic solution during 0-120 minutes to form a mixture solution containing colloidal polymer particles;

agitating the mixture solution with an agitation speed of 400-3000 rpm during 1-240 minutes to aggregate and coalesce the colloidal polymer particles and remove the solvent without heating to solidify the aggregated and coalesced colloidal polymer particles to form toner particles.

2. The method of forming electrophotographic toner as claimed in claim 1, wherein the polymer resin comprises polyamides, polyesters, acrylic resins, polystyrenes, epoxy resins, styrene-acrylate copolymers, polyolefins, polycarbonate, polyacrylamide, ethylene-vinyl acetate, polyvinyl acetate, polyurethane, polyvinyl butyral, or a mixture thereof.

3. The method of forming electrophotographic toner as claimed in claim 1, wherein the organic solution further comprises a colorant, a release agent, or a charge control agent.

4. The method of forming electrophotographic toner as claimed in claim 3, wherein the release agent comprises silicon oil, paraffin, polyethylene wax, polypropylene wax, fatty acid wax, ester wax, long-chain alcohol, long-chain acid, animal wax, plant wax, synthetic wax, or a mixture thereof.

5. The method of forming electrophotographic toner as claimed in claim 1, wherein the anti-coagulant comprises water-soluble polymers, cationic, anionic, or non-ionic surfactants, inorganic oxide powders, or a mixture thereof.

6. The method of forming electrophotographic toner as claimed in claim 5, wherein the water-soluble polymer comprises polyvinyl alcohol, polyvinylpyrrolidone, methyl cellulose, ethyl cellulose, hyroxypropyl cellulose, hydroxyethyl methyl cellulose, hydroxypropyl ethyl cellulose, carboxymethyl cellulose and its salts, polyacrylic acid and its salts, polyacrylic amide, polystyrene sulfonate, acacia gum, copolymer of ethylene oxide and propylene oxide, or a mixture thereof.

7. The method of forming electrophotographic toner as claimed in claim 5, wherein the ionic surfactant comprises alkylsulfate, alkylsulfonate, alkylnaphthalene-sulfonate, fatty acid salt, alkylphosphate, alkylaminoate, or a mixture thereof.

8. The method of forming electrophotographic toner as claimed in claim 5, wherein the non-ionic surfactant comprises alkylpolyoxyethylene ether, alkylpolyphenol ethoxylate, alkylolamide, sorbitan ester, polyoxyethylene sorbitan ester, polyethylene oxide, polypropylene oxide, or a mixture thereof.

9. The method of forming electrophotographic toner as claimed in claim 1, wherein the toner particles are used in laser printers, copiers, multi-function office appliances, fax machines, or electrostatic image printers.

* * * * *